US006551203B2

(12) United States Patent
Ogg

(10) Patent No.: US 6,551,203 B2
(45) **Date of Patent: *Apr. 22, 2003**

(54) GOLF BALL WITH MULTIPLE SETS OF DIMPLES

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/846,737

(22) Filed: Apr. 30, 2001

(65) Prior Publication Data

US 2002/0010039 A1 Jan. 24, 2002

Related U.S. Application Data

(63) Continuation-in-part of application No. 09/398,919, filed on Sep. 16, 1999, now Pat. No. 6,224,499.

(51) Int. Cl.[7] ..... A63B 37/14
(52) U.S. Cl. ..... 473/383
(58) Field of Search ..... 473/378–384

(56) References Cited

U.S. PATENT DOCUMENTS

| | | | | |
|---|---|---|---|---|
| 3,034,791 A | | 5/1962 | Gallagher | |
| 3,940,145 A | | 2/1976 | Gentiluomo | |
| 3,989,568 A | | 11/1976 | Isaac | |
| 4,123,061 A | | 10/1978 | Dusbiber | |
| 4,560,168 A | | 12/1985 | Aoyama | |
| 4,762,326 A | | 8/1988 | Gobush | |
| 4,813,677 A | | 3/1989 | Oka | |
| 4,840,381 A | | 6/1989 | Ihara | |
| 4,880,241 A | | 11/1989 | Melvin | |
| 4,949,976 A | | 8/1990 | Gobush | |
| 4,979,747 A | | 12/1990 | Jonkouski | |
| 5,060,954 A | | 10/1991 | Gobush | |
| 5,106,887 A | | 4/1992 | Horiguchi | |
| 5,158,300 A | | 10/1992 | Aoyama | |
| 5,201,522 A | | 4/1993 | Pocklington | |
| 5,301,951 A | * | 4/1994 | Morell | 473/384 |
| 5,334,673 A | * | 8/1994 | Wu | 473/383 |
| 5,421,580 A | | 6/1995 | Sugimoto | |
| 5,566,943 A | | 10/1996 | Boehm | |
| 5,692,974 A | | 12/1997 | Wu | |
| 5,720,676 A | | 2/1998 | Shimosaka | |
| 5,735,757 A | | 4/1998 | Moriyama | |
| 5,752,889 A | | 5/1998 | Yamagishi | |
| 5,846,141 A | * | 12/1998 | Morgan et al. | 473/377 |
| 5,857,924 A | | 1/1999 | Miyagawa | |
| 5,885,172 A | | 3/1999 | Hebert | |
| 5,906,551 A | | 5/1999 | Kasashima | |
| 5,935,023 A | | 8/1999 | Maehara | |
| 5,957,786 A | | 9/1999 | Aoyama | |
| 6,039,660 A | | 3/2000 | Kasashima | |
| 6,053,820 A | | 4/2000 | Kasashima | |
| 6,213,898 B1 | * | 4/2001 | Ogg | 473/383 |
| 6,224,499 B1 | * | 5/2001 | Ogg | 473/383 |
| 6,299,552 B1 | * | 10/2001 | Morgan et al. | 473/384 |
| 6,331,150 B1 | * | 12/2001 | Ogg | 473/383 |

OTHER PUBLICATIONS

Louis G. Caschera, Jr., Strictlt Golf Balls, 1998, Strictly Golf, Inc., pp 28–29.*

* cited by examiner

*Primary Examiner*—Mark S. Graham
*Assistant Examiner*—Raeann Gordon
(74) *Attorney, Agent, or Firm*—Michael A. Catania

(57) ABSTRACT

A dimple pattern for a golf ball with multiple sets of dimples is disclosed herein. Each of the multiple sets of dimples has a different diameter. A preferred set of dimples is seven different dimples. The dimples may cover as much as eighty-six percent of the surface of the golf ball. The unique dimple pattern allows a golf ball to have shallow dimples with steeper entry angles. The unique dimple pattern also allows a golf ball to have greater low speed lift with a lower high speed drag. In a preferred embodiment, the golf ball has 384 dimples covering eighty-six percent of the surface.

13 Claims, 14 Drawing Sheets

GOLF BALL WITH MULTIPLE SETS OF DIMPLES

CROSS REFERENCES TO RELATED APPLICATIONS

This application is a continuation-in-part application of U.S. patent application Ser. No. 09/398,919 filed on Sep. 16, 1999, now U.S. Pat. No. 6,224,499.

STATEMENT REGARDING FEDERALLY SPONSORED RESEARCH OR DEVELOPMENT

Not Applicable

BACKGROUND OF THE INVENTION

1. Field of the Invention

The present invention relates to a golf ball. More specifically, the present invention relates to a dimple pattern for a golf ball in which the dimple pattern has different sizes of dimples.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a patent for a golf ball with indentations (dimples) that flew better and more accurately than golf balls with brambles. A. G. Spalding & Bros., purchased the U.S. rights to the patent and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's.

In the 1970's, dimple pattern innovations appeared from the major golf ball manufacturers. In 1973, Titleist introduced an icosahedron pattern which divides the golf ball into twenty triangular regions. An icosahedron pattern was disclosed in British Patent Number 377,354 to John Vernon Pugh, however, this pattern had dimples lying on the equator of the golf ball which is typically the parting line of the mold for the golf ball. Nevertheless, the icosahedron pattern has become the dominant pattern on golf balls today.

In the late 1970's and the 1980's the mathematicians of the major golf ball manufacturers focused their intention on increasing the dimpled surface area (the area covered by dimples) of a golf ball. The dimpled surface for the ATTI pattern golf balls was approximately 50%. In the 1970's, the dimpled surface area increased to greater than 60% of the surface of a golf ball. Further breakthroughs increased the dimpled surface area to over 70%. U.S. Pat. No. 4,949,976 to William Gobush discloses a golf ball with 78% dimple coverage with up to 422 dimples. The 1990's have seen the dimple surface area break into the 80% coverage.

The number of different dimples on a golf ball surface has also increased with the surface area coverage. The ATTI pattern disclosed a dimple pattern with only one size of dimple. The number of different types of dimples increased, with three different types of dimples becoming the preferred number of different types of dimples. U.S. Pat. No. 4,813,677, to Oka et al., discloses a dimple pattern with four different types of dimples on surface where the non-dimpled surface cannot contain an additional dimple. United Kingdom patent application number 2,157,959, to Steven Aoyama, discloses dimples with five different diameters. Further, William Gobush invented a cuboctahedron pattern that has dimples with eleven different diameters. See 500 *Year of Golf Balls,* Antique Trade Books, page 189. However, inventing dimple patterns with multiple dimples for a golf ball only has value if such a golf ball is commercialized and available for the typical golfer to play.

Additionally, dimple patterns have been based on the sectional shapes, such as octahedron, dodecahedron and icosahedron patterns. U.S. Pat. No. 5,201,522 discloses a golf ball dimple pattern having pentagonal formations with equally number of dimples therein. U.S. Pat. No. 4,880,241 discloses a golf ball dimple pattern having a modified icosahedron pattern wherein small triangular sections lie along the equator to provide a dimple-free equator.

Although there are hundreds of published patents related to golf ball dimple patterns, there still remains a need to improve upon current dimple patterns. This need is driven by new materials used to manufacture golf balls, and the ever increasing innovations in golf clubs.

BRIEF SUMMARY OF THE INVENTION

The present invention provides a novel dimple pattern that reduces high speed drag on a golf ball while increasing its low speed lift thereby providing a golf ball that travels greater distances. The present invention is able to accomplish this by providing multiples sets of dimples arranged in a pattern that covers as much as eighty-six percent of the surface of the golf ball.

One aspect of the present invention is a dimple pattern on a golf ball in which the dimple pattern has at least five different sets of dimples. The golf ball includes first, second, third, fourth and fifth pluralities of dimples disposed on the surface. Each of the first plurality of dimples has a first diameter. Each of the second plurality of dimples has a second diameter that is greater than the first diameter. Each of the third plurality of dimples has a third diameter that is greater than the second diameter. Each of the fourth plurality of dimples has a fourth diameter that is greater than the third diameter. Each of the fifth plurality of dimples has a fifth diameter that is greater than the fourth diameter. The first, second, third, fourth and fifth pluralities of dimples cover at least eighty percent of the surface of the golf ball.

The golf ball may also include a sixth plurality of dimples disposed on the surface with each of the sixth plurality of dimples having a sixth diameter that is greater than the fifth diameter. The first, second, third, fourth, fifth and sixth pluralities of dimples cover at least eighty-three percent of the surface of the golf ball.

The golf ball may further include at least one seventh dimple disposed on the surface. The at least one seventh dimple has a seventh diameter that is less than the first diameter. The first, second, third, fourth, fifth and sixth pluralities of dimples and the at least one seventh dimple cover at least eighty-six percent of the surface of the golf ball. The golf ball has an equator that divides the golf ball into a first hemisphere and a second hemisphere, and the first hemisphere may be unsymmetrical with the second hemisphere.

Another aspect of the present invention is a dimple pattern on a golf ball that provides greater low speed lift and lower high speed drag. The golf ball includes a plurality of different sets of dimples disposed on the surface. Each of the different sets of dimples having a different diameter than any other set of dimples. The plurality of different sets of dimples cover at least eighty-three percent of the surface of the golf ball. The golf ball has a lift coefficient greater than 0.20 at a Reynolds number of 70,000 and 2000 rpm, and a drag coefficient less than 0.232 at a Reynolds number of 180,000 and 3000 rpm.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
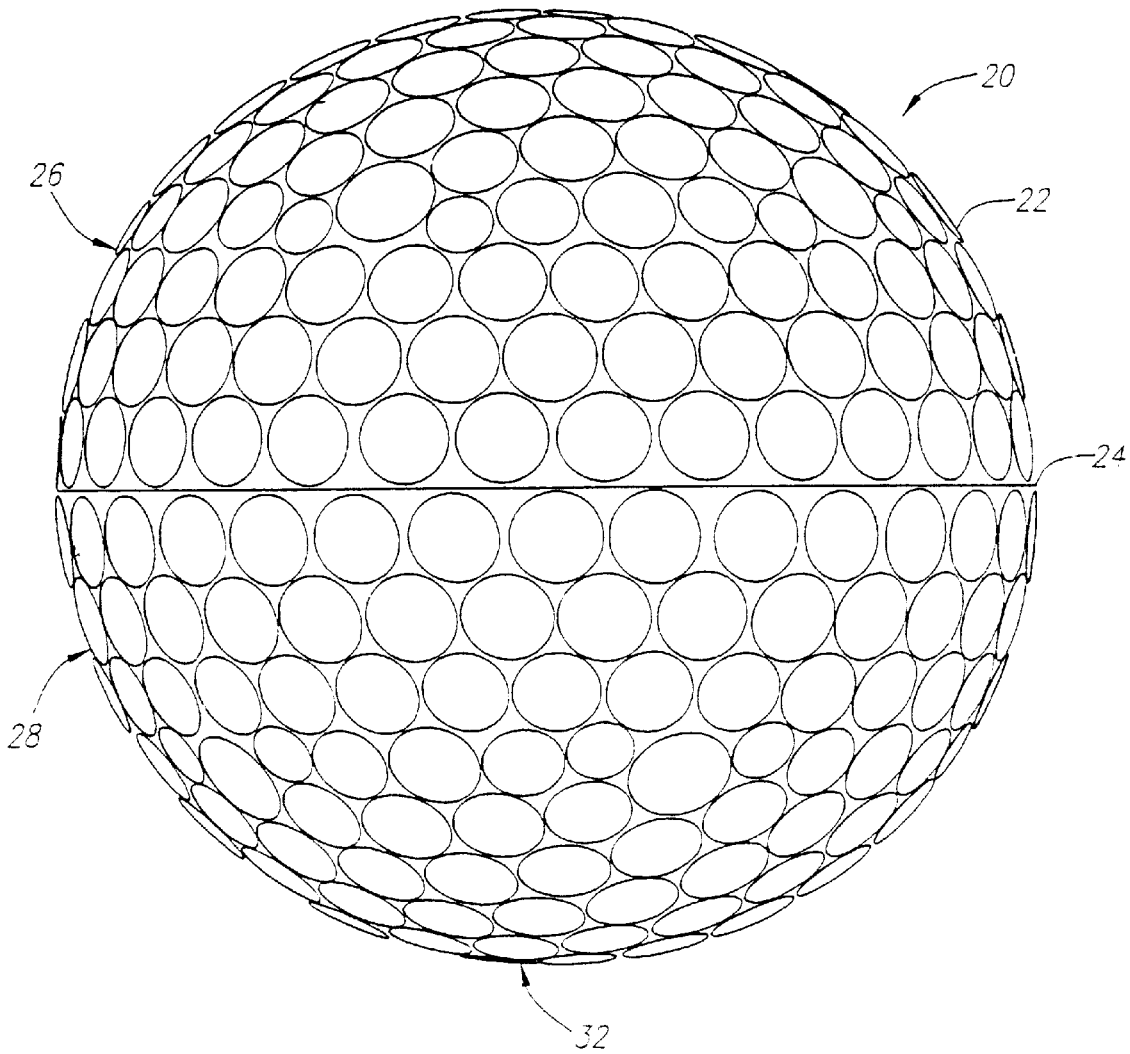
FIG. 1 is an equatorial view of a preferred embodiment of a golf ball of the present invention.
Figure 2:
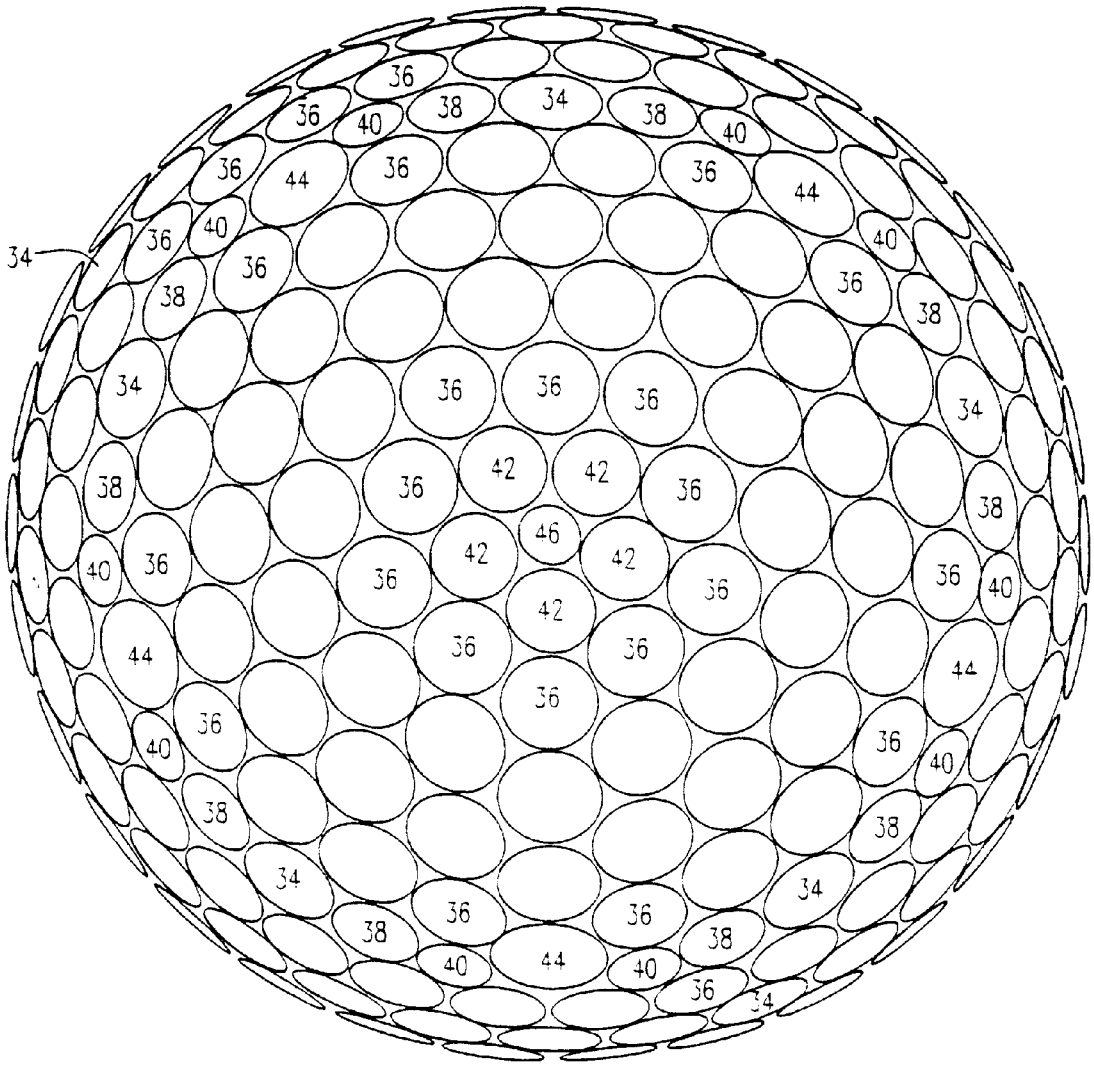
FIG. 2 is a polar view of the golf ball of FIG. 1.
Figure 3:
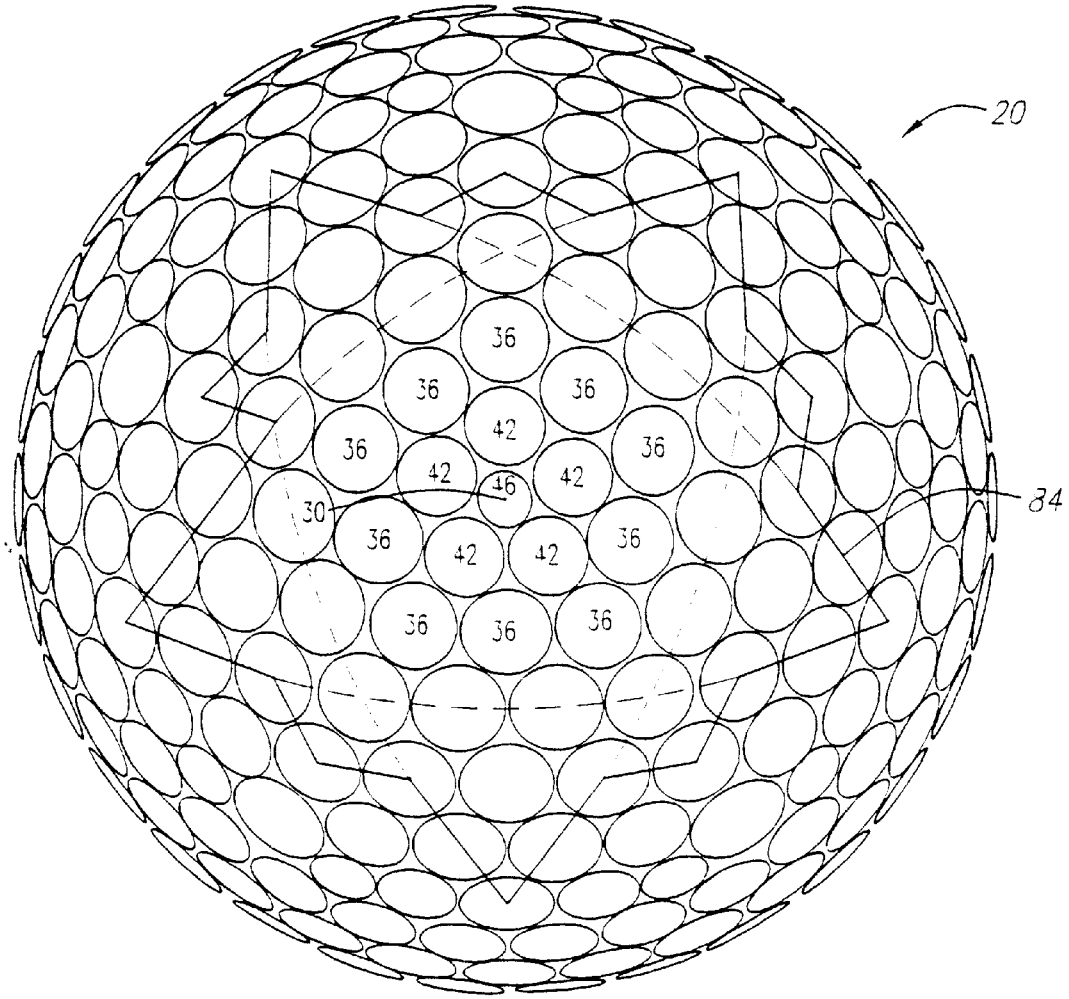
FIG. 3 is a polar view of the golf ball of FIG. 1 illustrating the star configuration.

As shown in FIGS. 1–3, a golf ball is generally designated 20. The golf ball may be a one-piece, two-piece, a three piece, or the like golf ball. Further, the three-piece golf ball may have a wound layer, or a solid boundary layer. The cover of the golf ball 20 may be any suitable material. A preferred cover for a three-piece golf ball is a cover composed of a thermoset polyurethane material. A preferred cover for a two-piece golf ball is a blend of ionomers. The thickness of the cover for a two piece is preferably 0.070 inch, while the thickness of the cover for a three-piece golf ball is preferably 0.030 inch. However, those skilled in the pertinent art will recognize that other cover materials may be utilized without departing from the scope and spirit of the present invention. The golf ball 20 may have a finish of a basecoat and/or top coat. The PGA compression of the golf ball is preferably between 70 to 110.

The golf ball 20 has a surface 22. The golf ball 20 also has an equator 24 dividing the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

On the surface 22, in both hemispheres 26 and 28, are 382 dimples partitioned into seven different sets of dimples. A first set of dimples 34 are the most numerous dimples consisting of two-hundred twenty dimples in the preferred embodiment. A second set of dimples 36 are the next most numerous dimples consisting of one-hundred dimples. A third set of dimples 38 and a fourth set of dimples 40 are the next most numerous with each set 38 and 40 consisting of twenty dimples in the preferred embodiment. A fifth set of dimples 42 and a sixth set of dimples 44 are the next most numerous with each set 42 and 44 consisting of ten dimples in the preferred embodiment. The seventh set of dimples 46 consist of only two dimples. In a preferred embodiment, the 382 dimples account for 86% of the surface 22 of the golf ball.

The two dimples of the seventh set of dimples 46 are each disposed on respective poles 30 and 32. Each of the fifth set of dimples 42 is adjacent one of the seventh set of dimples 46. The five dimples of the fifth set of dimples 42 that are disposed within the first hemisphere 26 are each an equal distance from the equator 24 and the first pole 30. The five dimples of the fifth set of dimples 42 that are disposed within the second hemisphere 28 are each an equal distance from the equator 24 and the second pole 32. These polar dimples 42 and 46 account for approximately 2% of the surface 22 of the golf ball 20.

Figure 8:
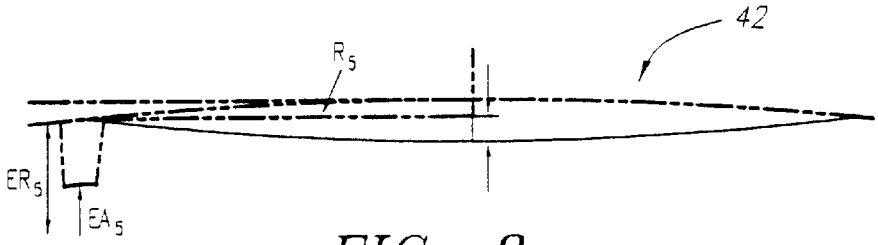
FIG. 8 is an enlarged cross-sectional view of a dimple of a fifth set of dimples of the golf ball of the present invention.
Figure 10:
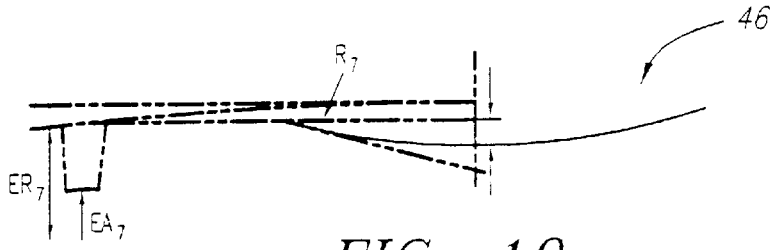
FIG. 10 is an enlarged cross-sectional view of a dimple of a seventh set of dimples of the golf ball of the present invention.

A cross-section of a dimple of the fifth set of dimples 42 is shown in FIG. 8. The radius $R_5$ of the dimple 42 is approximately 0.0720 inches, the chord depth $C_5$ is approximately 0.0054 inches, the entry angle $\theta_5$ is approximately 15.7 degrees, and the edge radius $ER_5$ is approximately 0.0336 inches. A cross-section of a dimple of the seventh set of dimples 46 is shown in FIG.10. The radius $R_7$ of the dimple 46 is approximately 0.0510 inches, the chord depth $C_7$ is approximately 0.0049 inches, the entry angle $\theta_7$ is approximately 13.4 degrees, and the edge radius $ER_7$ is approximately 0.0336 inches.

The ten dimples of the sixth set of dimples 44 account for approximately 3% of the surface 22 of the golf ball 20. The five dimples of the sixth set of dimples 44 that are disposed within the first hemisphere 26 are each an equal distance from the equator 24 and the first pole 30. The five dimples of the sixth set of dimples 44 that are disposed within the second hemisphere 28 are each an equal distance from the equator 24 and the second pole 32. Also, each of the sixth set of dimples 44 is adjacent to three different sets of dimples 34, 36 and 40.

Figure 9:
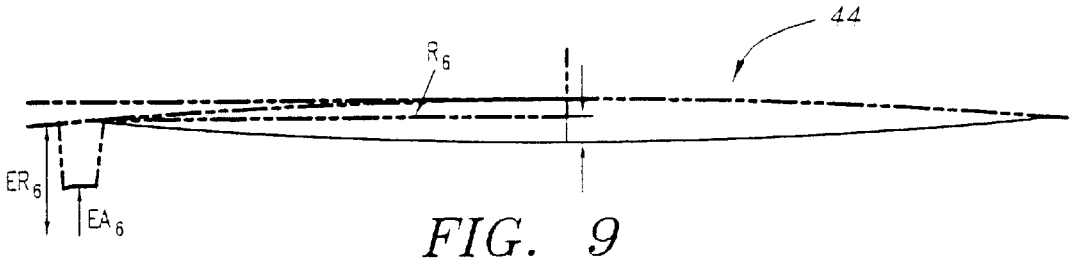
FIG. 9 is an enlarged cross-sectional view of a dimple of a sixth set of dimples of the golf ball of the present invention.

A cross-section of a dimple of the sixth set of dimples 44 is shown in FIG.9. The radius $R_6$ of the dimple 44 is approximately 0.0930 inches, the chord depth $C_6$ is approximately 0.0051 inches, the entry angle $\theta_6$ is approximately 15.2 degrees, and the edge radius $ER_6$ is approximately 0.0333 inches. The extraordinarily large diameter of each of the sixth set of dimples 44 allows for the extraordinary surface coverage of the dimple pattern of the present invention. This is contrary to conventional thinking that teaches that dimples with smaller diameters would provide for greater surface coverage.

All of the fourth set of dimples 40 are adjacent to at least one of the sixth set of dimples 44. The twenty dimples of the fourth set of dimples 40 cover approximately 2.7% of the surface 22 of the golf ball 20. The ten dimples of the fourth set of dimples 40 that are disposed within the first hemisphere 26 are each an equal distance from the equator 24 and the first pole 30. The ten dimples of the fourth set of dimples 40 that are disposed within the second hemisphere 28 are each an equal distance from the equator 24 and the second pole 32. Also, each of the fourth set of dimples 40 is adjacent to three different sets of dimples 36, 38 and 44.

Figure 7:
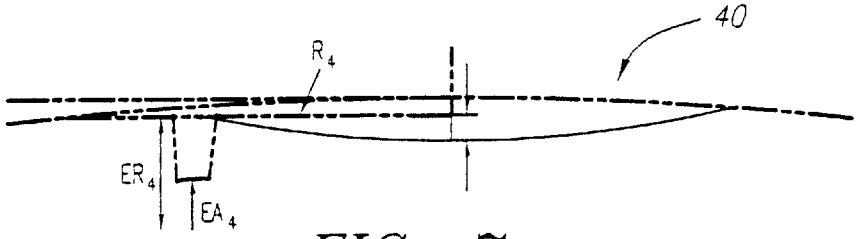
FIG. 7 is an enlarged cross-sectional view of a dimple of a fourth set of dimples of the golf ball of the present invention.

A cross-section of a dimple of the fourth set of dimples 40 is shown in FIG. 7. The radius $R_4$ of the dimple 40 is approximately 0.062 inches, the chord depth $C_4$ is approximately 0.0052 inches, the entry angle $\theta_4$ is approximately 15.2 degrees, and the edge radius $ER_4$ is approximately 0.0358 inches.

All of the third set of dimples 38 are adjacent to at least one of the sixth set of dimples 44. The twenty dimples of the third set of dimples 38 cover approximately 3.8% of the surface 22 of the golf ball 20. The ten dimples of the third set of dimples 38 that are disposed within the first hemisphere 26 are each an equal distance from the equator 24 and the first pole 30. The ten dimples of the third set of dimples 38 that are disposed within the second hemisphere 28 are each an equal distance from the equator 24 and the second pole 32. Also, each of the fourth set of dimples 38 is adjacent to three different sets of dimples 34, 36 and 40.

Figure 6:
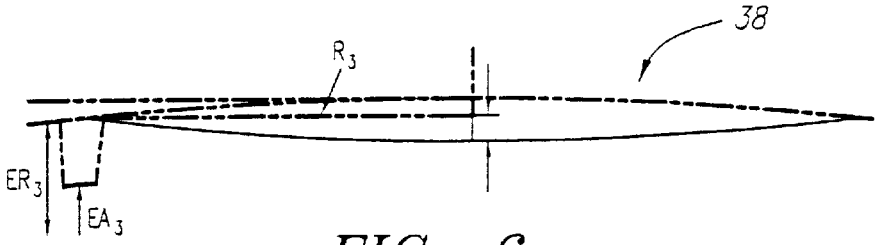
FIG. 6 is an enlarged cross-sectional view of a dimple of a third set of dimples of the golf ball of the present invention.

A cross-section of a dimple of the third set of dimples 38 is shown in FIG. 6. The radius $R_3$ of the dimple 38 is approximately 0.074 inches, the chord depth $C_3$ is approximately 0.0053 inches, the entry angle $\theta_3$ is approximately 15.3 degrees, and the edge radius $ER_3$ is approximately 0.0344 inches.

The two-hundred twenty dimples of the first set of dimples 34 are the most influential of the different sets of dimples 34–46 due to their number, size and placement on the surface 22 of the golf ball 20. The two-hundred twenty dimples of the first set of dimples 34 cover approximately 53% of the surface 22 of the golf ball 20. The one-hundred ten dimples of the first set of dimples 34 that are disposed within the first hemisphere 26 are disposed in either a first row 80 and a second row 82 above the equator 24, or a pseudo-star configuration 84 about the first pole 30 that is best illustrated in FIG. 3. Similarly, the one-hundred ten dimples of the first set of dimples 34 that are disposed within the second hemisphere 28 are disposed in either a first row 90 and a second row 92 below the equator 24, or a pseudo-star configuration 94, not shown, about the second pole 32, not shown.

Figure 4:
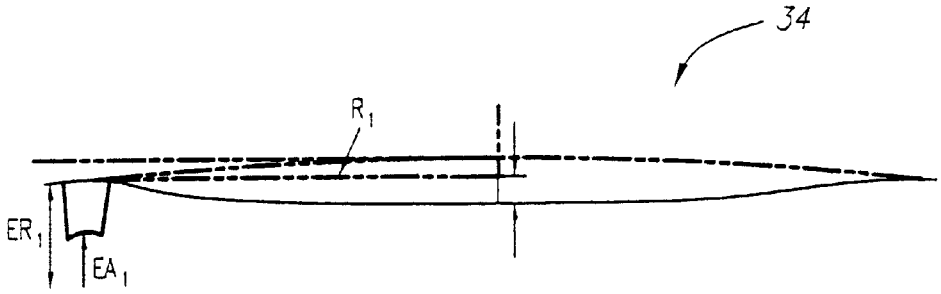
FIG. 4 is an enlarged cross-sectional view of a dimple of a first set of dimples of the golf ball of the present invention.
Figure 4A:
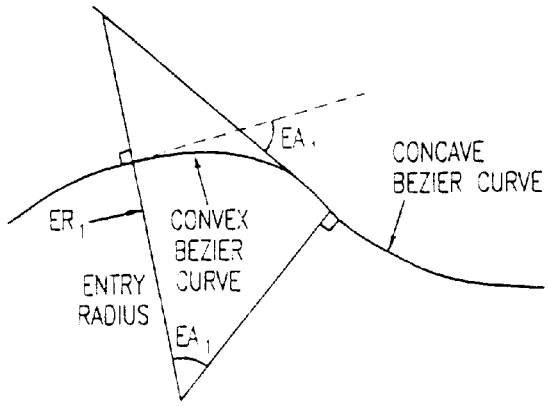
FIG. 4A is an isolated cross-sectional view to illustrate the definition of the entry radius.

A cross-section of a dimple of the first set of dimples 34 is shown in FIG. 4. The radius $R_1$ of the dimple 34 is approximately 0.0834 inches, the chord dept $C_1$ is approximately 0.0053 inches, the entry angle $\theta_1$ is approximately 15.3 degrees, and the edge radius $ER_1$ is approximately 0.0344 inches. Unlike the use of the term "entry radius" or "edge radius" in the prior art, the edge radius as defined herein is a value utilized in conjunction with the entry angle to delimit the concave and convex segments of the dimple contour. The first and second derivatives of the two Bézier curves are forced to be equal at this point defined by the edge radius and the entry angle, as shown in FIG. 4A. A more detailed description of to contour of the dimples is set forth in U.S. Pat. No. 6,331,150, filed on Sep. 16, 1999, entitled Golf Ball Dimples With Curvature Continuity, which is hereby incorporated by reference in its entirety.

The one-hundred dimples of the second set of dimples 36 are the next most influential of the different sets of dimples 34–46 due to their number, size and placement on the surface 22 of the golf ball 20. The one-hundred dimples of the second set of dimples 36 cover approximately 22% of the surface 22 of the golf ball 20. Thus, together the first set of dimples 34 and the second set of dimples 36 cover over approximately 75% of the surface 22 of the golf ball 20. The fifty dimples of the second set of dimples 36 that are disposed within the first hemisphere 26 are disposed in either a third row 86 above the equator, a second pentagon 102 about the first pole 30, or along a transition latitudinal region 70. Similarly, the fifty dimples of the second set of dimples 36 that are disposed within the second hemisphere 28 are disposed in either a third row 96 below the equator 24, a second pentagon 102*a*, not shown, about the second pole 32, or along a transition latitudinal region 72.

Figure 5:
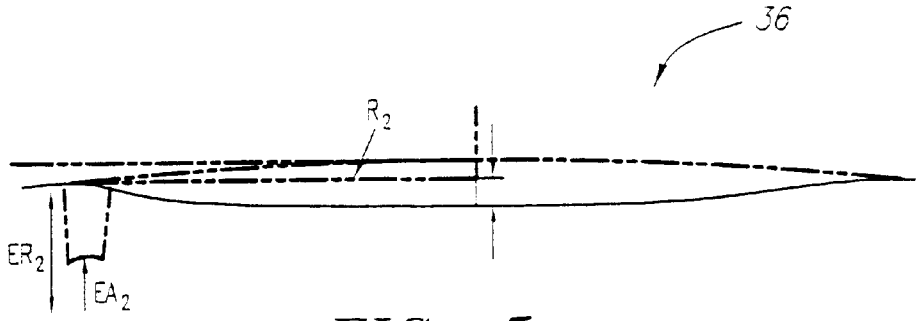
FIG. 5 is an enlarged cross-sectional view of a dimple of a second set of dimples of the golf ball of the present invention.

A cross-section of a dimple of the second set of dimples 36 is shown in FIG. 5. The radius $R_2$ of the dimple 36 is approximately 0.079 inches, the chord depth $C_2$ is approximately 0.0053 inches, the entry angle $\theta_2$ is approximately 15.1 degrees, and the edge radius $ER_2$ is approximately 0.0315 inches.

Figure 1A:
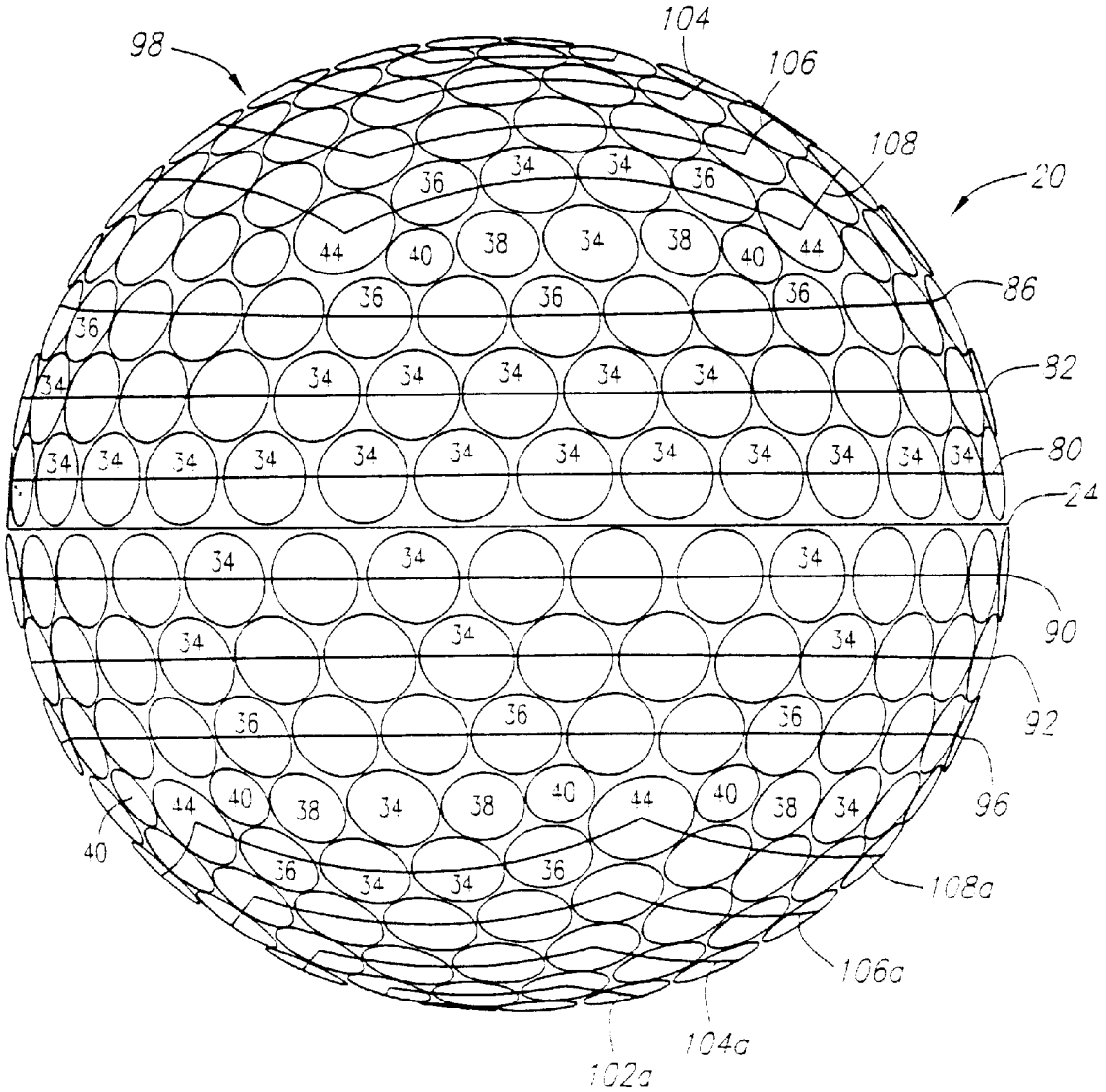
FIG. 1A is the view of FIG. 1 illustrating the rows of dimples.
Figure 2A:
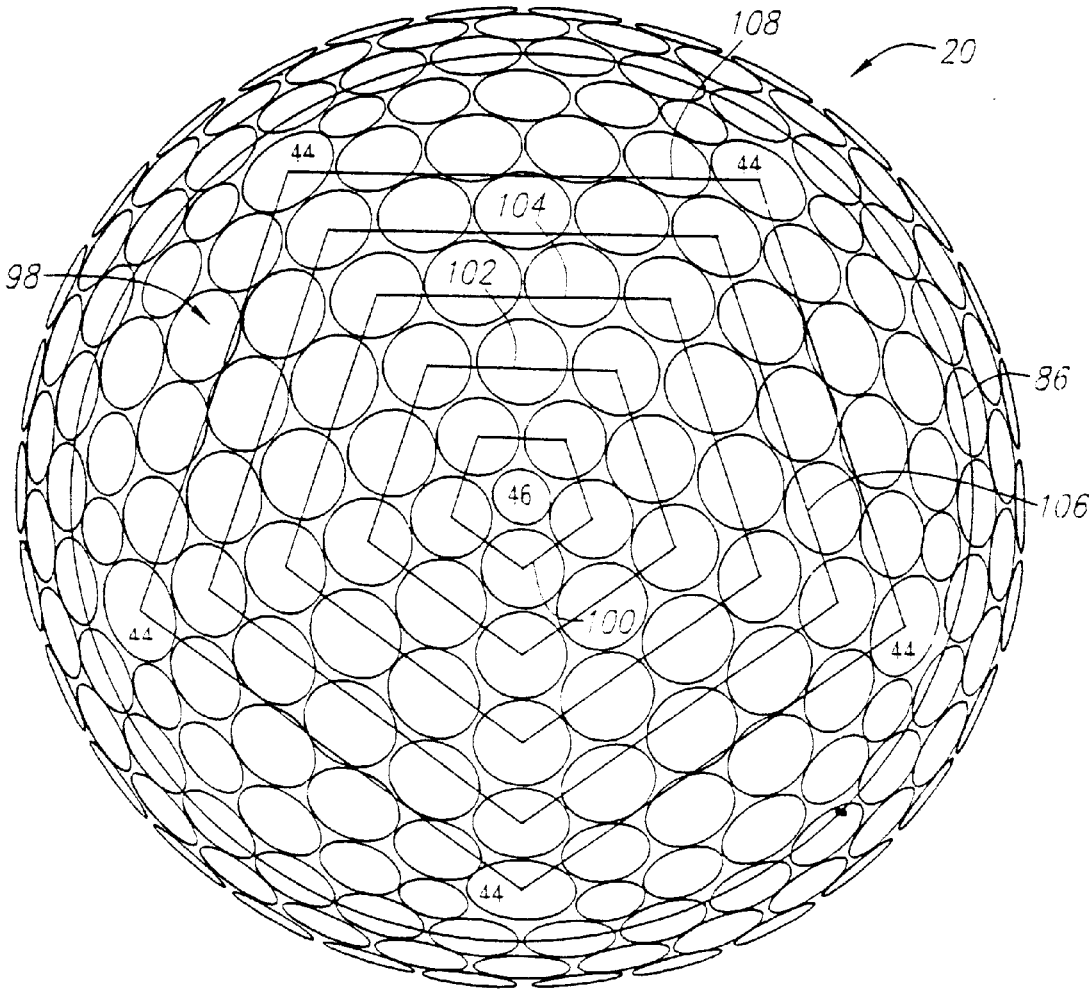
FIG. 2A is the view of FIG. 2 illustrating the cascading pentagons of dimples.

As best illustrated in FIG. 1A, each hemisphere 26 and 28 begins with three rows from the equator 24. The first and second rows 80 and 82 of the first hemisphere 26 and the first and second rows 90 and 92 of the second hemisphere 22 are composed of the first set of dimples 34. The third row 86 of the first hemisphere 26 and the third row 96 of the second hemisphere 28 are composed of the second set of dimples 36. This pattern of rows is utilized to achieve greater surface coverage of dimples on the golf ball 20. However, as mentioned previously, conventional teaching would dictate that additional rows of smaller diameter dimples should be utilized to achieve greater surface area coverage. However, the dimple pattern of the present invention transitions from rows of equal dimples into a pentagonal region 98. The pentagonal region 98 is best seen in FIG. 2A. A similar pentagonal region 98*a*, not shown, is disposed about the second pole 32. The pentagonal region 98 has five pentagons 100, 102, 104, 106 and 108 expanding from the first pole 30. Similar pentagons 100*a*, 102*a*, 104*a*, 106*a* and 108*a* expand from the second pole 32. The first pentagon 100 consists of the fifth set of dimples 42. The second pentagon 102 consists of the second set of dimples 36. The third pentagon 104 consists of the first set of dimples 34. The fourth pentagon 106 also consists of the first set of dimples 34. The fifth pentagon 108 consists of the first set of dimples 34, the second set of dimples 36, and the sixth set of dimples. However, the greater fifth pentagon 108' would include the fifth pentagon 108 and all dimples disposed between the third row 86 and the fifth pentagon 108. The pentagonal region 98 allows for the greater surface area of the dimple pattern of the present invention.

Figure 2B:
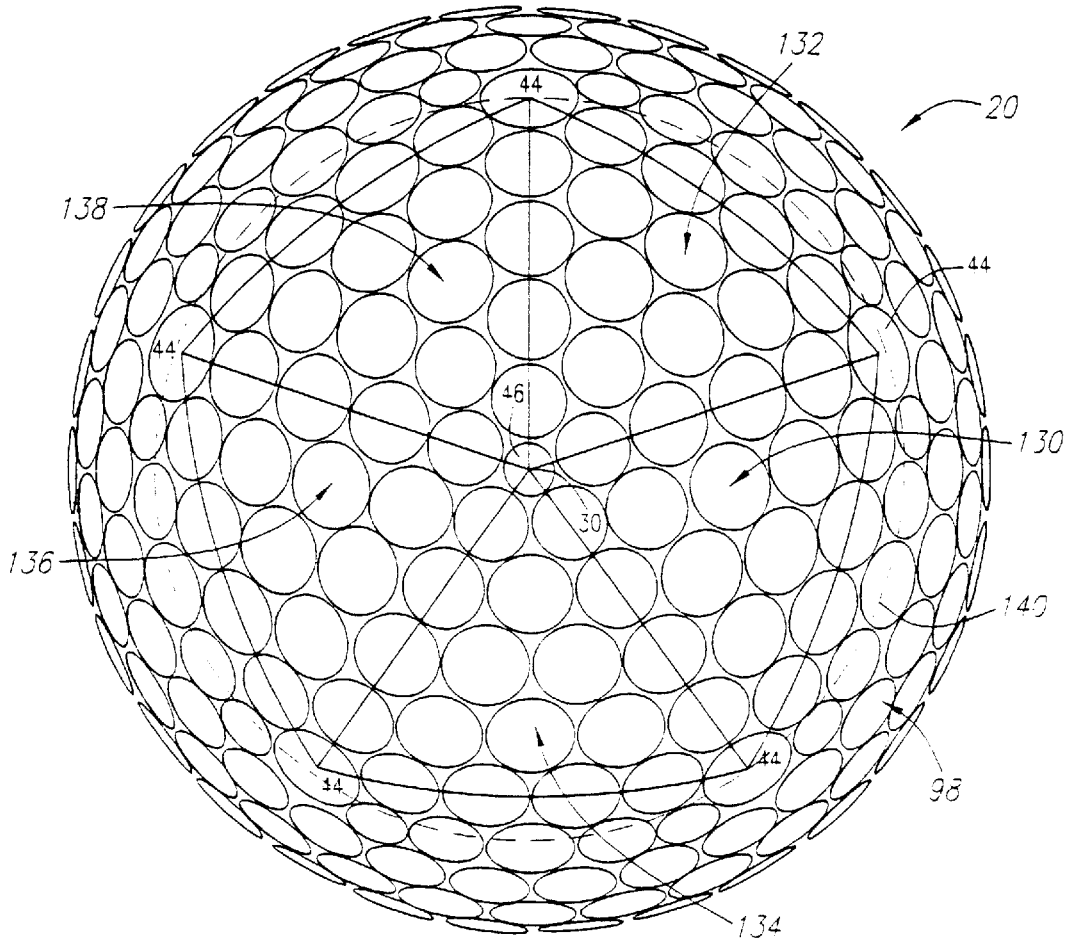
FIG. 2B is the view of FIG. 2 illustrating the single encompassing pentagon of dimples.

FIG. 2B illustrates five triangles 130–138 that compose the pentagonal region 98. Dashed line 140 illustrates the extent of the greater pentagonal region 98' which overlaps with the transition latitudinal region 70.

Figure 1B:
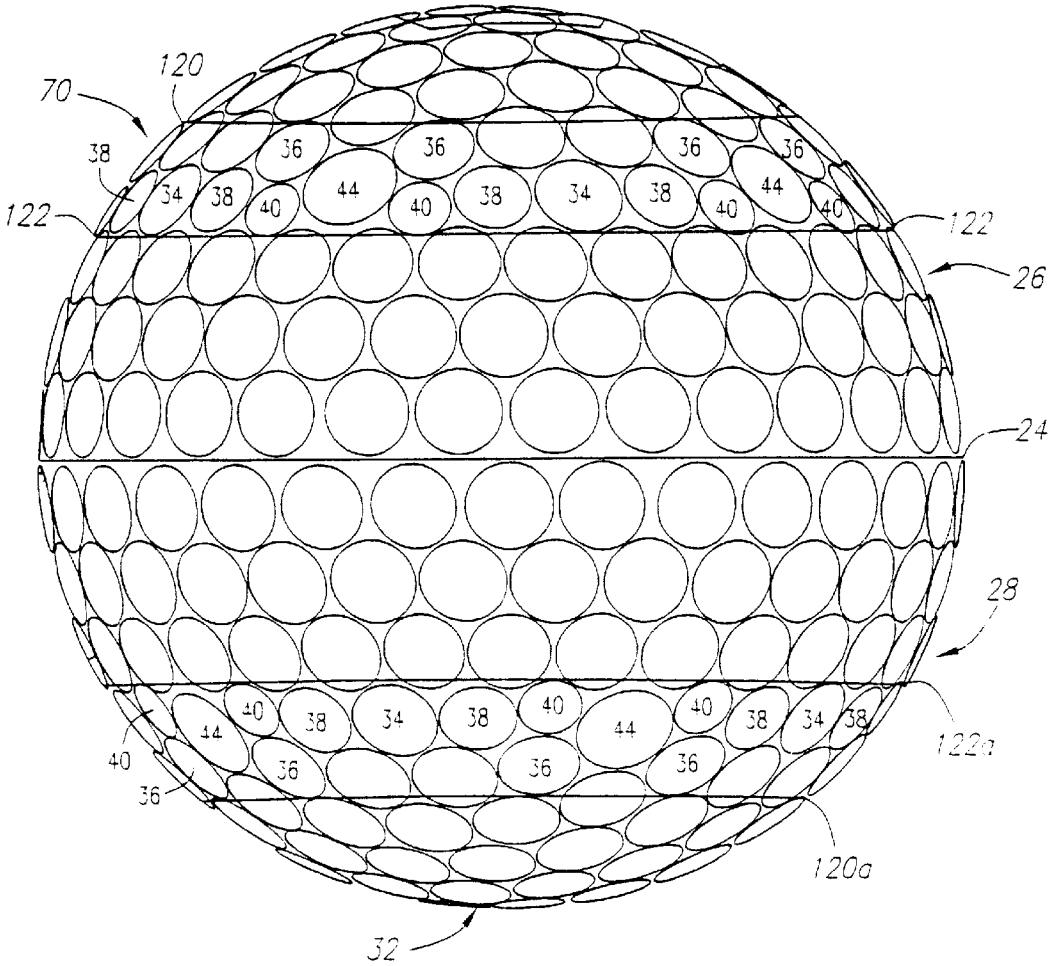
FIG. 1B is the view of FIG. 1 illustrating the transition region of dimples.

As best illustrated in FIG. 1B, all of the dimples of the third set of dimples 38, the fourth set of dimples 40 and the sixth set of dimples 44 are disposed within the transition latitudinal regions 70 and 72. The transition latitudinal regions 70 and 72 transition the dimple pattern of the present invention from the rows 80, 82, 86, 90, 92 and 96 to the pentagonal regions 98 and 98*a*. Each of the transition latitudinal regions 70 and 72 cover a circumferencial area between 40 to 60 longitudinal degrees from the equator 24 in their respective hemispheres 26 and 28. The first transition latitudinal region 70 has a polar boundary 120 at approximately 60 longitudinal degrees from the equator 24, and an equatorial boundary 122 at approximately 40 longitudinal degrees from the equator 24. Similarly, the second transition latitudinal region 72 has a polar boundary 120*a* at approximately 60 longitudinal degrees from the equator 24, and an equatorial boundary 122*a* at approximately 40 longitudinal degrees from the equator 24.

Figure 11:
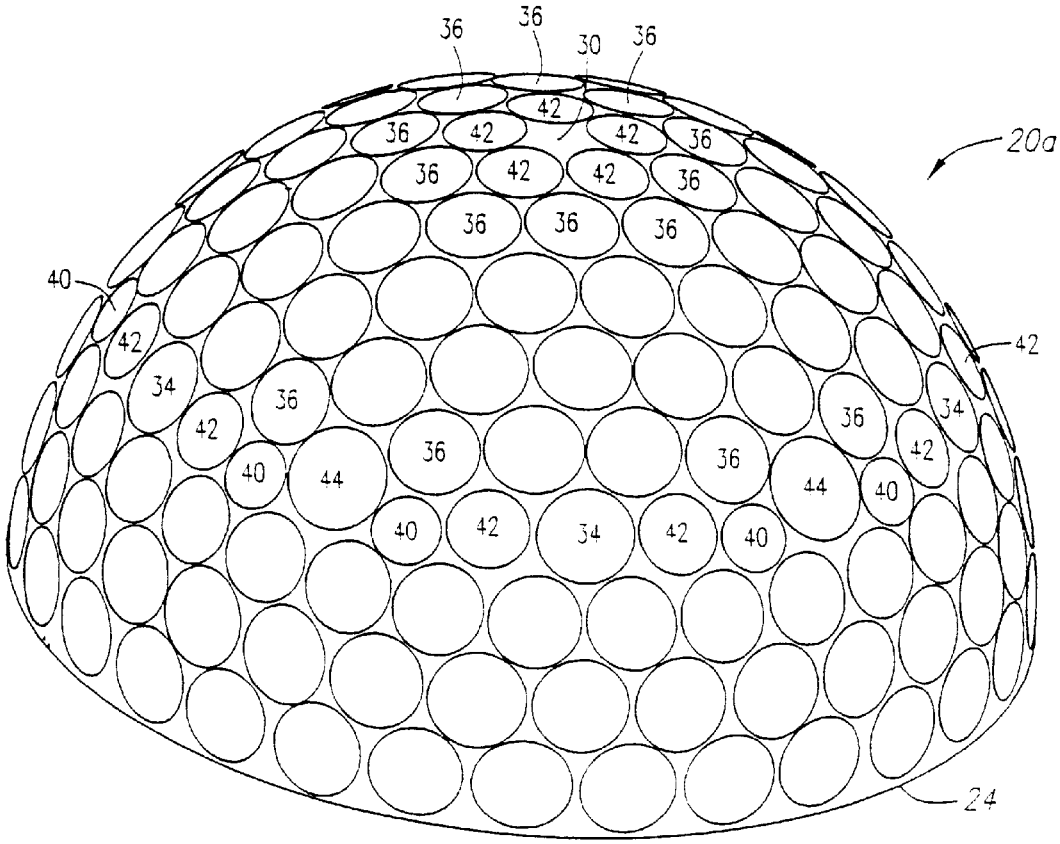
FIG. 11 is a polar view of an alternative embodiment of the golf ball of the present invention.
Figure 12:
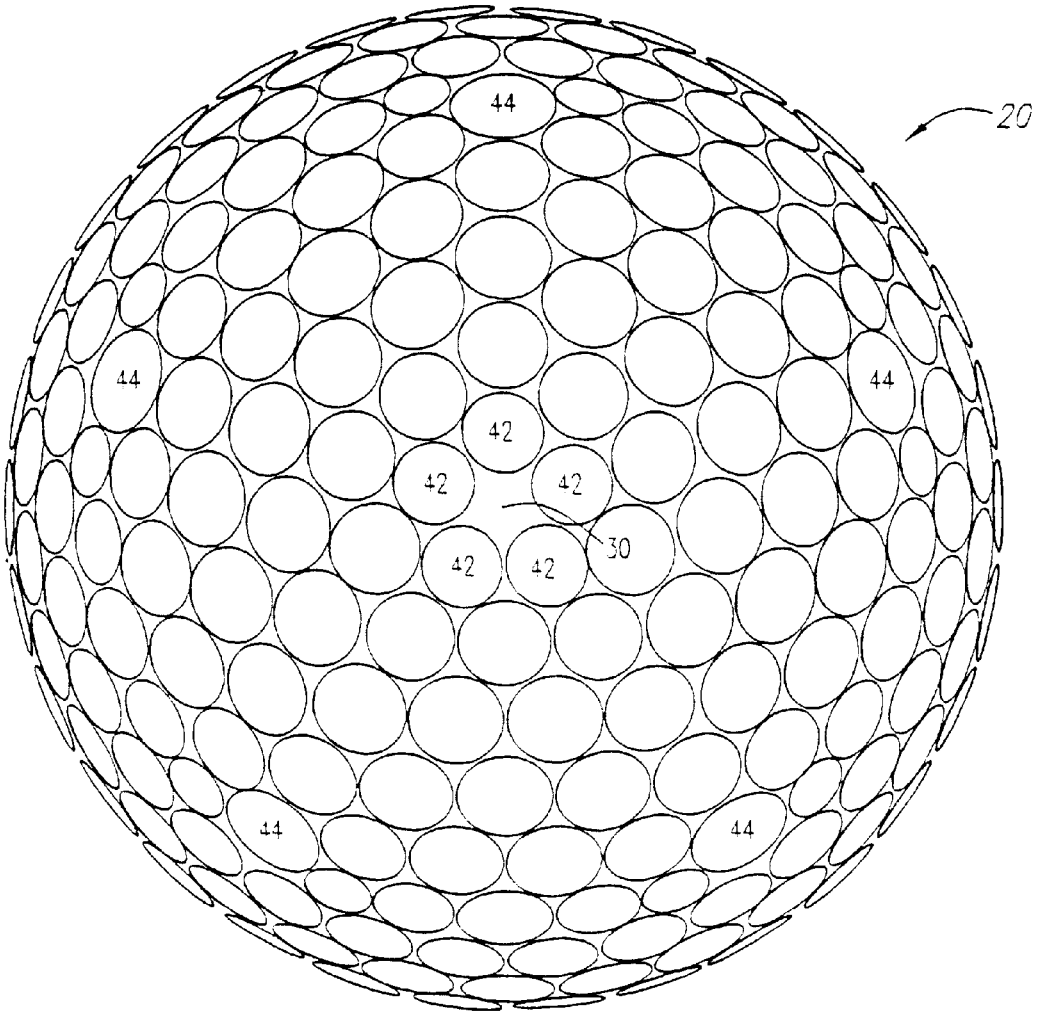
FIG. 12 is an equatorial view of yet another alternative embodiment of a golf ball of the present invention.

Alternative embodiments of the dimple pattern of the present invention are illustrated in FIGS. 11 and 12. The dimple pattern on the golf ball 20*a* of FIG. 11 only has five different sets of dimples 34, 36, 40, 42 and 44. The dimple pattern on the golf ball 20*b* of FIG. 12 only has six different sets of dimples 34, 36, 38, 40, 42 and 44. Both of the dimple patterns of the golf balls 20*a* and 20*b* have had the seventh set of dimples 46 that are disposed at the poles 30 and 32 removed, and the dimple patter of the golf ball 20*a* has had all of the dimples of the third set of dimples 38 substituted with dimples from the fifth set of dimples 42.

The force acting on a golf ball in flight is calculated by the following trajectory equation:

$$F=F_L+F_D+G \quad \text{(A)}$$

wherein F is the force acting on the golf ball; $F_L$ is the lift; $F_D$ is the drag; and G is gravity. The lift and the drag in equation A are calculated by the following equations:

$$F_L=0.5C_LA\rho v^2 \quad \text{(B)}$$

$$F_D=0.5C_DA\rho v^2 \quad \text{(C)}$$

wherein $C_L$ is the lift coefficient; $C_D$ is the drag coefficient; A is the maximum cross-sectional area of the golf ball; ρ is the density of the air; and v is the golf ball airspeed.

The drag coefficient, $C_D$, and the lift coefficient, $C_L$, may be calculated using the following equations:

$$C_{D-2}F_{D/}A\rho v^2 \quad \text{(D)}$$

$$C_{L-2}F_{L/}A\rho v^2 \quad \text{(E)}$$

The Reynolds number R is a dimensionless parameter that quantifies the ratio of inertial to viscous forces acting on an object moving in a fluid. Turbulent flow for a dimpled golf ball occurs when R is greater than 40000. If R is less than 40000, the flow may be laminar. The turbulent flow of air about a dimpled golf ball in flight allows it to travel farther than a smooth golf ball.

The Reynolds number R is calculated from the following equation:

$$R=vD\rho/\mu \quad \text{(F)}$$

wherein v is the average velocity of the golf ball; D is the diameter of the golf ball (usually 1.68 inches); ρ is the density of air (0.00238 slugs/ft$^3$ at standard atmospheric conditions); and μ is the absolute viscosity of air ($3.74\times10^{-7}$ lb*sec/ft$^2$ at standard atmospheric conditions). A Reynolds number, R, of 180,000 for a golf ball having a USGA approved diameter of 1.68 inches, at standard atmospheric conditions, approximately corresponds to a golf ball hit from the tee at 200 ft/s or 136 mph, which is the point in time during the flight of a golf ball when the golf ball attains its highest speed. A Reynolds number, R, of 70,000 for a golf ball having a USGA approved diameter of 1.68 inches, at standard atmospheric conditions, approximately corresponds to a golf ball at its apex in its flight, 78 ft/s or 53 mph, which is the point in time during the flight of the golf ball when the travels at its slowest speed. Gravity will increase the speed of a golf ball after its reaches its apex.

Figure 13:
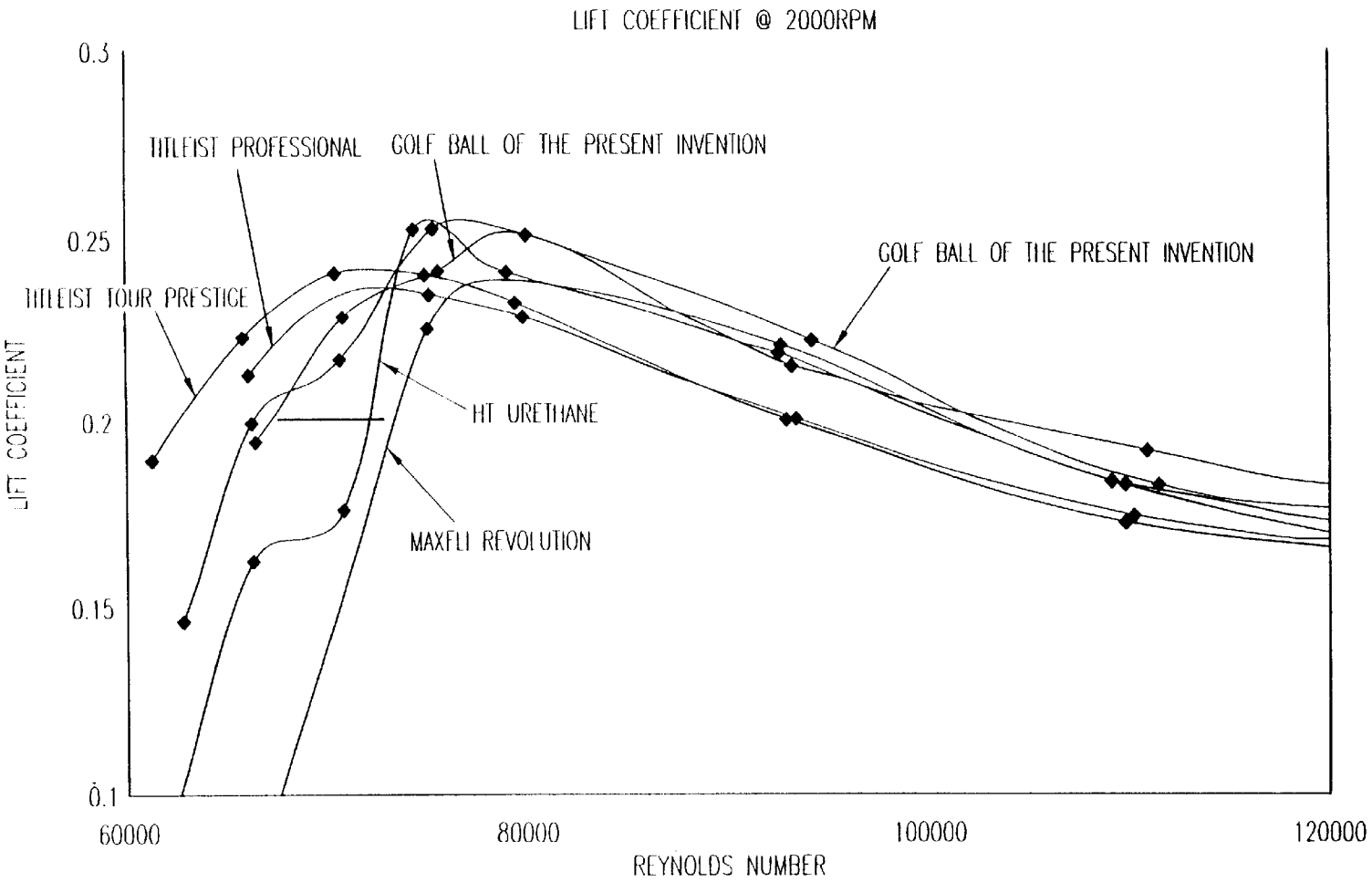
FIG. 13 is a graph of the lift coefficient versus Reynolds number.
Figure 14:
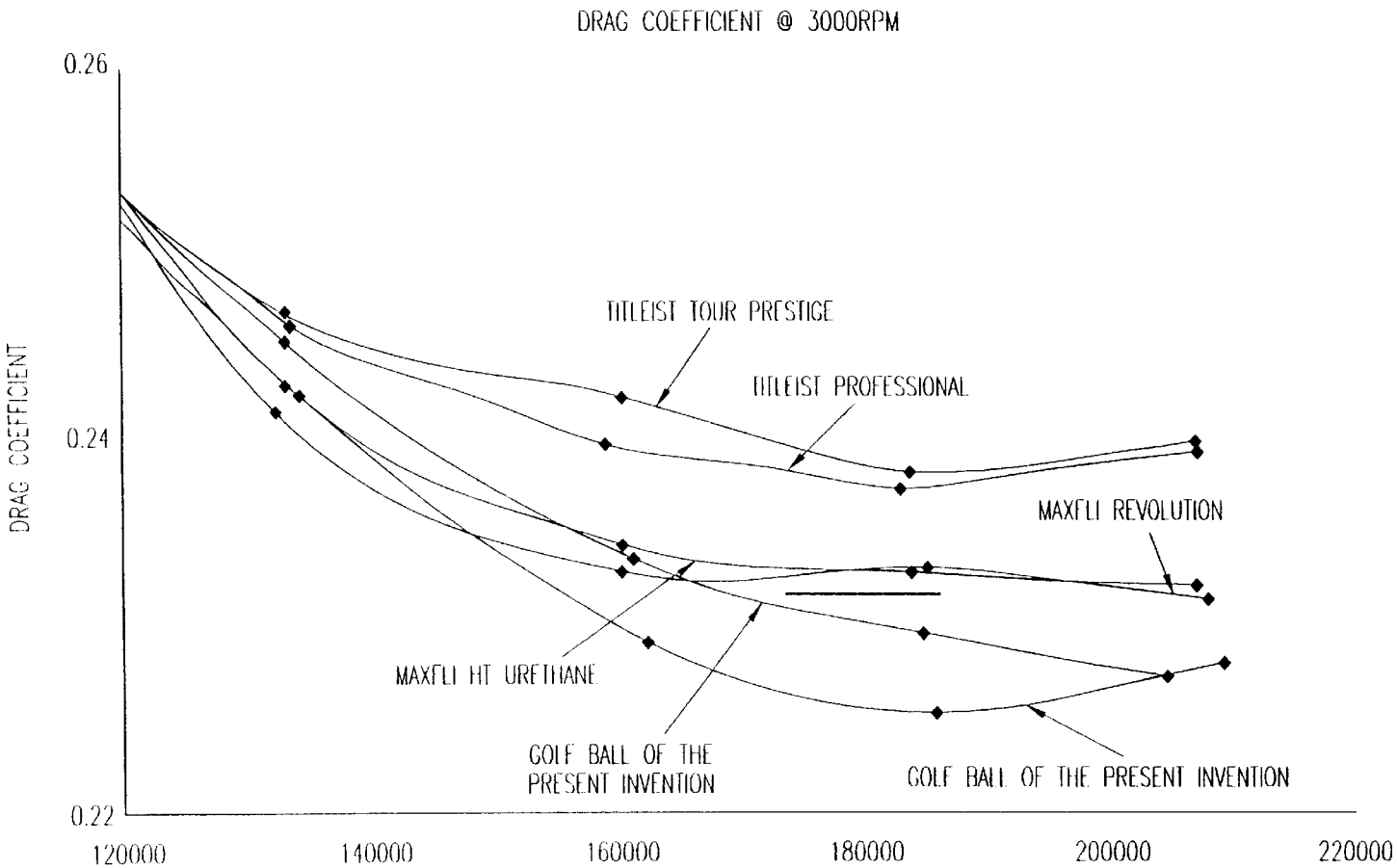
FIG. 14 is a graph of the drag coefficient versus Reynolds number.
Figure 15:
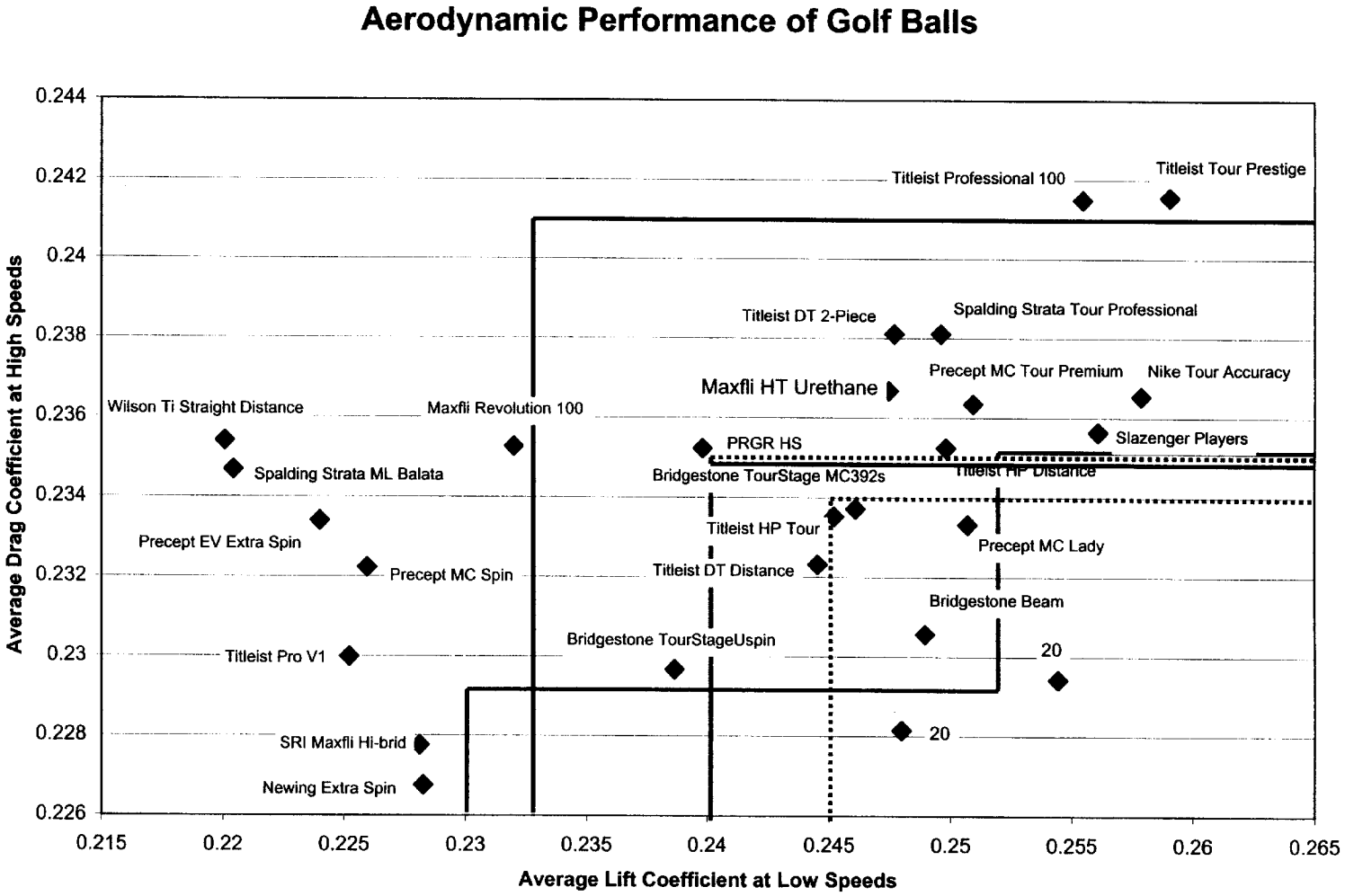
FIG. 15 is a graph of the average drag coefficient versus the average lift coefficient.

FIG. 13 illustrates the lift coefficient of a golf ball 20 with the dimple pattern of the present invention thereon as compared to the Titlelist PROFESSIONAL, the Titlelist TOUR PRESTIGE, the Maxfli REVOLUTION and the Maxfli HT URETHANE. FIG. 14 illustrates the drag coefficient of a golf ball 20 with the dimple pattern of the present invention thereon as compared to the Titlelist PROFESSIONAL, the Titlelist TOUR PRESTIGE, the Maxfli REVOLUTION and the Maxfli HT URETHANE. FIG. 15 illustrates the average drag coefficient versus the average lift coefficient of a golf ball 20 with the dimple pattern of the present invention thereon as compared to Titlelist PROFESSIONAL, the Titlelist TOUR PRESTIGE, the Maxfli REVOLUTION the Titlelist HP DISTANCE 202, the Titlelist HP ECLIPSE 204, the SRI Maxfli HI-BRD (from Japan) 206, the Wilson CYBERCORE PRO DISTANCE 208, the Titleist PRO V1 210, the Bridgestone TOUR STAGE MC392 (from Japan) 212, the Precept MC LADY 214, the Nike TOUR ACCURACY 216, and the Titlelist DT DISTANCE 218, the Maxfli HT URETHANE, and others. The average lift coefficient is the average of the four lift coefficient values consisting of the lift coefficient of the golf ball at a Reynolds number of 70,000 and 2000 rpm, the lift coefficient of the golf ball at a Reynolds number of 70,000 and 3000 rpm, the lift coefficient of the golf ball at a Reynolds number of 80,000 and 2000 rpm, and the lift coefficient of the golf ball at a Reynolds number of 80,000 and 3000 rpm. The average drag coefficient is the average of the six drag coefficient values consisting of the drag coefficient of the golf ball at a Reynolds number of 120,000 and 2000 rpm, the drag coefficient of the golf ball at a Reynolds number of 120,000 and 3000 rpm, the drag coefficient of the golf ball at a Reynolds number of 150,000 and 2000 rpm, the drag coefficient of the golf ball at a Reynolds number of 150,000 and 3000 rpm, the drag coefficient of the golf ball at a Reynolds number of 180,000 and 2000 rpm, and the drag coefficient of the golf ball at a Reynolds number of 180,000 and 3000 rpm.

All of the golf balls for the comparison test, including the golf ball 20 with the dimple pattern of the present invention, have a thermoset polyurethane cover. The golf balls 20 with the dimple pattern of the present invention were constructed as set forth in U.S. Pat. No. 6,190,268 filed on Jul. 27, 1999, for a Golf Ball With A Polyurethane Cover which pertinent parts are hereby incorporated by reference. The aerodynamics of the dimple pattern of the present invention provides a greater lift with a reduced drag thereby translating into a golf ball 20 that travels a greater distance than golf balls of similar constructions.

As compared to other golf balls having polyurethane covers, the golf ball 20 of the present invention is the only one that combines a lower drag coefficient at high speeds, and a greater lift coefficient at low speeds. Specifically, as shown in FIGS. 13 and 14, none of the other golf balls have a lift coefficient, $C_L$, greater than 0.18 at a Reynolds number of 70,000, and a drag coefficient $C_D$ less than 0.23 at a Reynolds number of 180,000. For example, while the Titleist PROFESSIONAL has a $C_L$ greater than 0.18 at a Reynolds number of 70,000, its $C_D$ is greater than 0.23 at a Reynolds number of 180,000. Also, while the Maxfli REVOLUTION has a drag coefficient $C_D$ greater than 0.23 at a Reynolds number of 180,000, its $C_L$ is less than 0.18 at a Reynolds number of 70,000.

In this regard, the Rules of Golf, approved by the United States Golf Association ("USGA") and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the golf ball 20 has a dimple pattern that enables the golf ball 20 to meet, yet not exceed, these limits.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball having a surface, the golf ball comprising a core, a cover composed of an ionomer and a plurality of dimples, wherein the golf ball has a PGA compression ranging from 70 to 110 and the golf ball has an average lift coefficient greater than 0.23 and an avenge drag coefficient less than 0.229;

wherein the average lift coefficient is the average of the four lift coefficient values consisting of the lift coefficient of the golf ball at a Reynolds number of 70,000 and 2000 rpm, the lift coefficient of the golf ball at a Reynolds number of 70,000 and 3000 rpm, the lift coefficient of the golf ball at a Reynolds number of 80,000 and 2000 rpm, and the lift coefficient of the golf ball at a Reynolds number of 80,000 and 3000 rpm;

wherein the average drag coefficient is the average of the six drag coefficient values consisting of the drag coefficient of the golf ball at a Reynolds number of 120,000 and 2000 rpm, the drag coefficient of the golf ball at a Reynolds number of 120,000 and 3000 rpm, the drag coefficient of the golf ball at a Reynolds number of 150,000 and 2000 rpm, the drag coefficient of the golf ball at a Reynolds number of 150,000 and 3000 rpm, the drag coefficient of the golf ball at a Reynolds number of 180,000 and 2000 rpm, and the drag coefficient of the golf ball at a Reynolds number of 180,000 and 3000 rpm.

2. The golf ball according to claim 1 wherein the golf ball comprises:

a first plurality of dimples disposed on the surface, each of the first plurality of dimples having a first diameter;

a second plurality of dimples disposed on the surface, each of the second plurality of dimples having a second diameter, the second diameter greater than the first diameter;

a third plurality of dimples disposed on the surface, each of the third plurality of dimples having a third diameter, the third diameter greater than the second diameter;

a fourth plurality of dimples disposed on the surface, each of the fourth plurality of dimples having a fourth diameter, the fourth diameter greater than the third diameter; and a fifth plurality of dimples disposed on the surface, each of the fifth plurality of dimples having a fifth diameter, the fifth diameter greater than the fourth diameter;

wherein the first, second, third, fourth and fifth pluralities of dimples cover at least eighty percent of the surface of the golf ball.

3. The golf ball according to claim 2 further comprising a sixth plurality of dimples disposed on the surface, each of the sixth plurality of dimples having a sixth diameter, the sixth diameter greater than the fifth diameter, wherein the first, second, third, fourth, fifth and sixth pluralities of dimples cover at least eighty-three percent of the surface of the golf ball.

4. The golf ball according to claim 3 further comprising at least one seventh dimple disposed on the surface, the at least one seventh dimple having a seventh diameter, the seventh diameter less than the first diameter, wherein the first, second, third, fourth, fifth and sixth pluralities of dimples and the at least one seventh dimple cover at least eighty-six percent of the surface of the golf ball.

5. A golf ball comprising:

a core; and a cover composed of a urethane material and having multiple sets of dimples wherein the golf ball has an average lift coefficient greater than 0.24 and an average drag coefficient less than 0.236;

wherein the average lift coefficient is the average of the four lift coefficient values consisting of the lift coefficient of the golf ball at a Reynolds number of 70,000 and 2000 rpm, the lift coefficient of the golf ball at a Reynolds number of 70,000 and 3000 rpm, the lift coefficient of the golf ball at a Reynolds number of 80,000 and 2000 rpm, and the lift coefficient of the golf ball at a Reynolds number of 80,000 and 3000 rpm;

wherein the average drag coefficient is the average of the six drag coefficient values consisting of the drag coefficient of the golf ball at a Reynolds number of 120,000 and 2000 rpm, the drag coefficient of the golf ball at a Reynolds number of 120,000 and 3000 rpm, the drag coefficient of the golf ball at a Reynolds number of 150,000 and 2000 rpm, the drag coefficient of the golf ball at a Reynolds number of 150,000 and 3000 rpm, the drag coefficient of the golf ball at a Reynolds number of 180,000 and 2000 rpm, and the drag coefficient of the golf ball at a Reynolds number of 180,000 and 3000 rpm.

6. The golf ball according to claim 5 further comprising an intermediate layer between the core and cover.

7. The golf ball according to claim 5 wherein the golf ball comprises:

a first plurality of dimples disposed on the surface, each of the first plurality of dimples having a first diameter;

a second plurality of dimples disposed on the surface, each of the second plurality of dimples having a second diameter, the second diameter greater than the first diameter;

a third plurality of dimples disposed on the surface, each of the third plurality of dimples having a third diameter, the third diameter greater than the second diameter;

a fourth plurality of dimples disposed on the surface, each of the fourth plurality of dimples having a fourth diameter, the fourth diameter greater than the third diameter; and a fifth plurality of dimples disposed on the surface, each of the fifth plurality of dimples having a fifth diameter, the fifth diameter greater than the fourth diameter;

wherein the first, second, third, fourth and fifth pluralities of dimples cover at least eighty percent of the surface of the golf ball.

8. A golf ball comprising:

a core; and a cover composed of a thermoset urethane material and having multiple sets of dimples wherein the golf ball has an average lift coefficient greater than 0.233 and an average drag coefficient less than 0.241;

wherein the average lift coefficient is the average of the four lift coefficient values consisting of the lift coefficient of the golf ball at a Reynolds number of 70,000 and 2000 rpm, the lift coefficient of the golf ball at a Reynolds number of 70,000 and 3000 rpm, the lift coefficient of the golf ball at a Reynolds number of 80,000 and 2000 rpm, and the lift coefficient of the golf ball at a Reynolds number of 80,000 and 3000 rpm;

wherein the average drag coefficient is the average of the six drag coefficient values consisting of the drag coefficient of the golf ball at a Reynolds number of 120,000 and 2000 rpm, the drag coefficient of the golf ball at a Reynolds number of 120,000 and 3000 rpm, the drag coefficient of the golf ball at a Reynolds number of 150,000 and 2000 rpm, the drag coefficient of the golf ball at a Reynolds number of 150,000 and 3000 rpm, the drag coefficient of the golf ball at a Reynolds number of 180,000 and 2000 rpm, and the drag coefficient of the golf ball at a Reynolds number of 180,000 and 3000 rpm.

9. The golf ball according to claim 8 further comprising an intermediate layer between the core and cover.

10. The golf ball according to claim 8 wherein the golf ball comprises:

a first plurality of dimples disposed on the surface, each of the first plurality of dimples having a first diameter;

a second plurality of dimples disposed on the surface, each of the second plurality of dimples having a second diameter, the second diameter greater than the first diameter;

a third plurality of dimples disposed on the surface, each of the third plurality of dimples having a third diameter, the third diameter greater than the second diameter;

a fourth plurality of dimples disposed on the surface, each of the fourth plurality of dimples having a fourth diameter, the fourth diameter greater than the third diameter; and a fifth plurality of dimples disposed on the surface, each of the fifth plurality of dimples having a fifth diameter, the fifth diameter greater than the fourth diameter;

wherein the first, second, third, fourth and fifth pluralities of dimples cover at least eighty percent of the surface of the golf ball.

11. A golf ball comprising:

a core; and a cover having multiple sets of dimples wherein the golf ball has an average lift coefficient greater than 0.245 and an average drag coefficient less than 0.234;

wherein the average lift coefficient is the average of the four lift coefficient values consisting of the lift coefficient of the golf ball at a Reynolds number of 70,000 and 2000 rpm, the lift coefficient of the golf ball at a Reynolds number of 70,000 and 3000 rpm, the lift coefficient of the golf ball at a Reynolds number of 80,000 and 2000 rpm, and the lift coefficient of the golf ball at a Reynolds number of 80,000 and 3000 rpm;

wherein the average drag coefficient is the average of the six drag coefficient values consisting of the drag coefficient of the golf ball at a Reynolds number of 120,000 and 2000 rpm, the drag coefficient of the golf ball at a Reynolds number of 120,000 and 3000 rpm, the drag coefficient of the golf ball at a Reynolds number of 150,000 and 2000 rpm, the drag coefficient of the golf ball at a Reynolds number of 150,000 and 3000 rpm, the drag coefficient of the golf ball at a Reynolds number of 180,000 and 2000 rpm, and the drag coefficient of the golf ball at a Reynolds number of 180,000 and 3000 rpm.

12. The golf ball according to claim 11 further comprising an intermediate layer between the core and cover.

13. The golf ball according to claim 11 wherein the golf ball comprises:

a first plurality of dimples disposed on the surface, each of the first plurality of dimples having a first diameter;

a second plurality of dimples disposed on the surface, each of the second plurality of dimples having a second diameter, the second diameter greater than the first diameter;

a third plurality of dimples disposed on the surface, each of the third plurality of dimples having a third diameter, the third diameter greater than the second diameter;

a fourth plurality of dimples disposed on the surface, each of the fourth plurality of dimples having a fourth diameter, the fourth diameter greater than the third diameter; and a fifth plurality of dimples disposed on the surface, each of the fifth plurality of dimples having a fifth diameter, the fifth diameter greater than the fourth diameter;

wherein the first, second, third, fourth and fifth pluralities of dimples cover at least eighty percent of the surface of the golf ball.

* * * * *